US006354957B1

(12) United States Patent
Saito

(10) Patent No.: US 6,354,957 B1
(45) **Date of Patent: *Mar. 12, 2002**

(54) GOLF CLUB SHAFT

(75) Inventor: Satoshi Saito, Tokyo (JP)

(73) Assignee: Daiwa Seiko, Inc., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/048,106

(22) Filed: Mar. 26, 1998

(30) Foreign Application Priority Data

Mar. 31, 1997 (JP) ..... 9-081727
Feb. 27, 1998 (JP) ..... 10-047863

(51) Int. Cl.[7] ..... A63B 53/10
(52) U.S. Cl. ..... 473/289; 473/319
(58) Field of Search ..... 473/316–323, 473/287, 289

(56) References Cited

U.S. PATENT DOCUMENTS 2,250,428 A * 7/1941 Vickery ..... 473/323
3,871,649 A * 3/1975 Kilshaw ..... 473/323
4,070,022 A * 1/1978 Braly ..... 473/289
4,319,750 A * 3/1982 Roy ..... 473/320
5,093,162 A * 3/1992 Fenton ..... 428/34.5
5,156,396 A * 10/1992 Akatsuka ..... 473/319
5,437,450 A * 8/1995 Akatsuka ..... 473/320
5,575,473 A * 11/1996 Turner ..... 473/298
5,599,242 A * 2/1997 Solviche ..... 473/318
5,626,529 A * 5/1997 Roy ..... 473/319
5,685,783 A * 11/1997 Akatsuka ..... 473/319

* cited by examiner

*Primary Examiner*—Stephen Blau
(74) *Attorney, Agent, or Firm*—Liniak, Berenato, Longacre & White

(57) ABSTRACT

A golf club shaft is characterized in that: tenacity can be exhibited by the golf club shaft; power can be accumulated in the process of swinging the golf club; it is easy for a golfer to hit a ball with the golf club; it is possible for the golfer to get distance when he hits a ball; the direction of a ball, which has been hit with the golf club, can be stabilized; the layer member is not detached from the golf club shaft; and damage of the layer member is prevented, so that the mechanical strength and durability of the golf club can be enhanced. The golf club shaft comprises: a main body layer on which a first fiber-reinforced prepreg sheet, the reinforcement fiber of which is impregnated with synthetic resin, is rolled; and an adjustment layer on which a second fiber-reinforced prepreg sheet, the reinforcement fiber of which is impregnated with synthetic resin, is rolled, the adjustment layer being arranged inside the main body layer or in an intermediate portion of the main body layer, wherein the specific gravity of the second fiber-reinforced prepreg sheet is higher than that of the first fiber-reinforced prepreg sheet, the elasticity of the second fiber-reinforced prepreg sheet is lower than that of the first fiber-reinforced prepreg sheet, and a ratio of the volume of the adjustment layer to the volume of all layers is in a range from 10 to 90%.

2 Claims, 3 Drawing Sheets

GOLF CLUB SHAFT

BACKGROUND OF THE INVENTION

The present invention relates to a golf club shaft and a set of golf clubs.

Conventionally, in order to adjust a swing balance of a golf club shaft, a weight made of metal is attached to an end portion or a grip portion of the golf club shaft so as to adjust the weight balance.

However, when the above conventional method is adopted in which only the weight is adjusted, it is impossible to adjust a bend balance of the shaft. Recently, golf club shafts made of carbon fiber are used. Therefore, the bounce property of the golf club shaft is high. On the other hand, the shaft made of carbon fiber lacks tenacity, and further it is impossible to accumulate power in the shaft in the process of swinging the golf club. For the above reasons, it is difficult for a golfer to hit a ball at good timing, and the golfer can not swing the golf club stably. Since the golfer can not swing the golf club stably, it is difficult for him to get distance and further the direction of a golf ball, which has been hit by the golfer, tends to fluctuate greatly.

When a weight member made of metal is only attached to a golf club shaft like a conventional golf club shaft, the weight member is damaged and detached from the golf club shaft by the bend repeatedly given to the shaft.

SUMMARY OF THE INVENTION

The present invention has been accomplished to solve the above problems. It is an object of the present invention to provide a golf club shaft characterized in that: tenacity can be exhibited by the golf club shaft; power can be accumulated in the process of swinging the golf club; it is easy for a golfer to hit a ball with the golf club; it is possible for the golfer to get distance when he hits a ball; the direction of a ball, which has been hit with the golf club, can be stabilized; the layer member is not separated from the golf club shaft; and damage of the layer member is prevented, so that the mechanical strength and durability of the golf club can be enhanced.

It is another object of the present invention to provide a set of golf clubs characterized in that the adjustment of swing balance can be effectively conducted among the golf clubs.

In order to solve the above problems, the present invention is to provide a golf club shaft comprising: a main body layer on which a first fiber-reinforced prepreg sheet, the reinforcement fiber of which is impregnated with synthetic resin, is rolled; and an adjustment layer on which a second fiber-reinforced prepreg sheet, the reinforcement fiber of which is impregnated with synthetic resin, is rolled, the adjustment layer being arranged inside the main body layer or in an intermediate portion of the main body layer, wherein the specific gravity of the second fiber-reinforced prepreg sheet is higher than that of the first fiber-reinforced prepreg sheet, the elasticity of the second fiber-reinforced prepreg sheet is lower than that of the first fiber-reinforced prepreg sheet, and a ratio of the volume of the adjustment layer to the volume of all layers is in a range from 10 to 90%.

Also, the present invention is to provide a golf club shaft comprising: a main body layer on which a first fiber-reinforced prepreg sheet, the reinforcement fiber of which is impregnated with synthetic resin, is rolled; and an adjustment layer on which a second fiber-reinforced prepreg sheet, the reinforcement fiber of which is impregnated with synthetic resin, is rolled, the adjustment layer being arranged inside the main body layer or in an intermediate portion of the main body layer, wherein the main body layer includes an axial direction fiber layer on which a fiber-reinforced prepreg sheet, the axial direction reinforcement fiber of which is impregnated with synthetic resin, is rolled, and the specific gravity of the second fiber-reinforced prepreg sheet is higher than that of the fiber-reinforced prepreg composing the axial direction fiber layer, the elasticity of the second fiber-reinforced prepreg sheet is lower than that of the fiber-reinforced prepreg composing the axial direction fiber layer, and the thickness of the adjustment layer is not lower than 25% of the thickness of the axial direction fiber layer of the main body layer.

Also, the present invention is to provide a set of golf clubs, each golf club comprising: a main body layer on which a first fiber-reinforced prepreg sheet, the reinforcement fiber of which is impregnated with synthetic resin, is rolled; and an adjustment layer on which a second fiber-reinforced prepreg sheet, the reinforcement fiber of which is impregnated with synthetic resin, is rolled, the adjustment layer being arranged inside the main body layer or in an intermediate portion of the main body layer, wherein a ratio of volume of the adjustment layer is increased as the golf club number is increased.

Also, the present invention is to provide a set of golf clubs, each golf club comprising: a main body layer on which a fiber-reinforced prepreg sheet, the reinforcement fiber of which is impregnated with synthetic resin, is rolled, wherein the flexural rigidity of the shaft from an end portion to a position distant from the end portion by 20 cm is reduced as the golf club number is increased.

The characteristic of the golf club shaft and the set of golf clubs of the present invention is an adjustment layer arranged inside or in the intermediate portion of the main body layer on which a fiber-reinforced prepreg sheet is rolled, wherein the specific gravity (density) of the fiber-reinforced prepreg sheet of the adjustment layer is higher than that of the fiber-reinforced prepreg sheet of the main body layer, and the elasticity of the fiber-reinforced prepreg sheet of the adjustment layer is lower than that of the fiber-reinforced prepreg sheet of the main body layer. In this case, the intermediate portion of the main body layer is defined as an intermediate layer arranged between a plurality of layers composing the main body layer. In this connection, it is possible to control the specific gravity and elasticity of the fiber-reinforced prepreg sheet by appropriately adjusting types of the reinforcement fiber and resin impregnated into the reinforcement fiber and also by appropriately adjusting a quantity of resin impregnated into the reinforcement fiber.

In the golf club shaft of the first embodiment of the present invention, a ratio of the volume of the adjustment layer to the volume of all layers is in a range from 10 to 90%. It is preferable that the ratio of the volume of the adjustment layer to the volume of all layers is in a range from 20 to 80%. In the case where the adjustment layer is formed over the entire length of the shaft, a ratio of the cross-sectional area of the adjustment layer to the cross-sectional area of the shaft in the radial direction may be used instead of the volume of the adjustment layer. When it is difficult to judge by the area of the cross-section in the radial direction, it is possible to find the ratio by the volume of the reinforcement fiber or the area of the cross section in the axial direction.

When the volume (cross-sectional area) of the adjustment layer is smaller than 10%, it is impossible to obtain a feeling of weight by which a low handicapper can be satisfied.

Further, when the volume of the adjustment layer is smaller than 10%, it is impossible to provide a sufficiently high effect of shock reduction. When the volume of the adjustment layer exceeds 90%, it is possible to provide an effect of shock reduction, however, the golf club becomes too heavy, and the golf club is not suitable for a golfer to use over a long period of time. Accordingly, the volume of the adjustment layer exceeding 90% is not preferable.

According to the first embodiment of the present invention, it is possible to provide a golf club shaft characterized in that: the balance of swing is good; tenacity is sufficiently high; and power can be accumulated when a golfer swings the golf club. According to the first embodiment of the present invention, it is possible to provide a golf club in which the layers are not separated from each other and the permanent set in fatigue of the shaft can be prevented.

In the golf club shaft of the second embodiment of the present invention, the thickness of the adjustment layer is not lower than 25% of the thickness of the axial direction fiber layer of the main body layer. It is preferable that the thickness of the adjustment layer is in a range from 30 to 80% of the thickness of the axial direction fiber layer of the main body layer. When the thickness of the adjustment layer is smaller than 25%, the golf club shaft becomes too light. Therefore, it is impossible to provide an appropriate feeling of weight, and further it is impossible to provide a good tenacity and bend.

According to the second embodiment of the present invention, it is possible to provide a golf club shaft characterized in that: the bend and weight balance is good when a golfer swings the golf club; tenacity is sufficiently high; and power can be accumulated when a golfer swings the golf club. According to the second embodiment of the present invention, it is possible to provide a golf club in which the layers are not separated from each other and the mechanical strength of the golf club can be enhanced.

In the golf club shaft of the third embodiment of the present invention, a ratio of volume of the adjustment layer is increased as the golf club number is increased.

According to the third embodiment of the present invention, it is possible to provide the same effect as that of the first and the second embodiment, and further the directivity of a ball, which has been hit by a golfer with a short iron golf club, can be stabilized. Furthermore, when a ball is hit by a golfer with a long iron golf club, it is possible to get distance and the directivity can be stabilized.

It is preferable that the total weight of the golf club shaft of the present invention is 70 to 140 g, and it is more preferable that the total weight of the golf club shaft of the present invention is 80 to 140 g.

When the golf club shaft and the set of golf clubs of the present invention are used, although the golf club shaft is composed of layers of prepreg, the bend and weight balance is so good that tenacity can be provided and power can be accumulated in the process of swinging the golf club.

DETAILED DESCRIPTION OF THE PREFERRED EMBODIMENT

Figure 1:
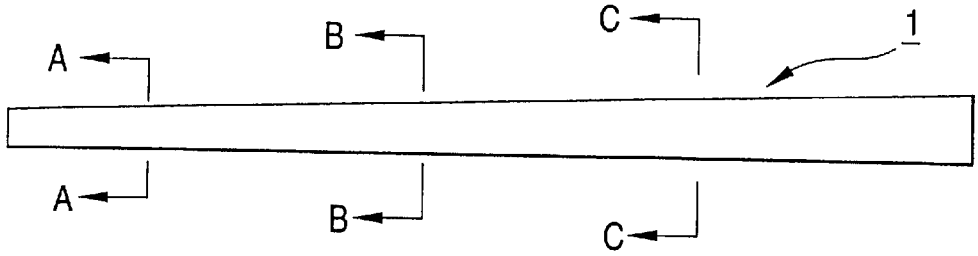
FIG. 1 is a schematic illustration of a golf club shaft 1 which is an embodiment of the present invention.

Referring to the drawings, an embodiment of the present invention will be specifically explained below.

Figure 2:
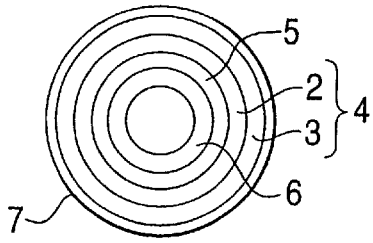
FIG. 2 is a cross-sectional view taken on line A—A in FIG. 1.
Figure 3:
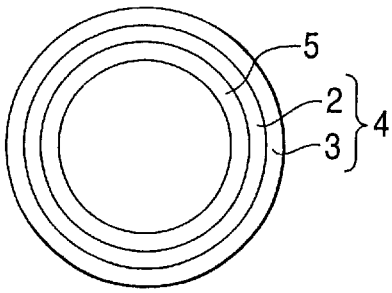
FIG. 3 is a cross-sectional view taken on line B—B in FIG. 1.
Figure 4:
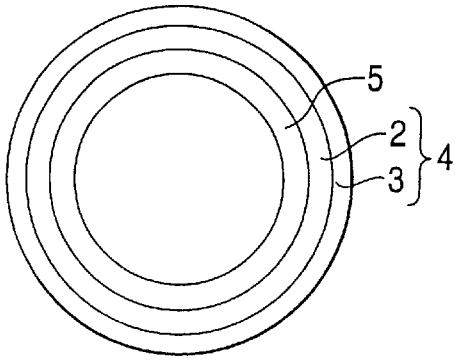
FIG. 4 is a cross-sectional view taken on line C—C in FIG. 1.

FIG. 1 is a schematic illustration of a golf club shaft 1 which is an embodiment of the present invention. FIGS. 2 to 4 are respectively a cross-sectional view taken on line A—A in FIG. 1, a cross-sectional view taken on line B—B in FIG. 1, and a cross-sectional view taken on line C—C in FIG. 1. In this connection, the cross-sectional side of A—A is a head attaching side, and the cross-sectional side of C—C is a grip attaching side.

As shown in FIGS. 2 to 4, the golf club shaft 1 includes: a main body layer 4 composed of an oblique direction fiber layer 2 and an axial direction fiber layer 3; and an adjustment layer 5 arranged inside the main body layer 4. In this connection, as shown in FIG. 2, only on the head attaching side of the golf club shaft 1, the first reinforcement layer 6 is arranged inside the adjusting layer 5, and the second reinforcement layer 7 is arranged outside the main body layer 4.

Both the oblique direction fiber layer 2 and the axial direction fiber layer 3 composing the main body layer 4 are made of fiber-reinforced prepreg in which reinforcement fiber is impregnated with synthetic resin. Examples of usable reinforcement fiber are: carbon fiber, glass fiber, aramid fiber, and boron fiber. Examples of usable synthetic resin impregnated into reinforce fiber are: epoxy resin, urethane resin, and polyester resin.

The direction of the reinforcement fiber on the oblique direction fiber layer 2 is inclined by a predetermined angle, for example, by ±45° with respect to the axial direction of the shaft 1. The direction of the reinforcement fiber on the axial direction fiber layer 3 is set in the axial direction of the shaft 1.

It is preferable that the thickness of the oblique direction fiber layer 2 is 0.5 to 1.5 mm. It is preferable that the modulus of elasticity of the oblique direction fiber layer 2 is not lower than 24 $Tf/mm^2$, and it is more preferable that the modulus of elasticity of the oblique direction fiber layer 2 is 30 to 90 $Tf/mm^2$. In this connection, it is preferable that the density (specific gravity) of the oblique direction fiber layer 2 is 1.5 to 1.9 $g/cm^3$.

Reinforcement fiber used for the axial direction fiber layer 3 is preferably made of carbon fiber. The modulus of elasticity of the axial direction fiber layer 3 is at least 20 $Tf/mm^2$. It is preferable that the modulus of elasticity of the axial direction fiber layer 3 is 24 to 65 $Tf/mm^2$. Except for carbon fiber, it is possible to use fiber of high elasticity and high mechanical strength such as boron fiber.

Resin used for the axial direction fiber layer 3 is preferably made of epoxy resin or polyester resin. It is preferable that the resin content in the axial direction fiber layer 3 is not higher than 30 weight %, and it is more preferable that the resin content in the axial direction fiber layer 3 is 10 to 25 weight %.

It is preferable that the thickness of the axial direction fiber layer 3 is 0.2 to 0.6 mm. It is preferable that the modulus of elasticity of the axial direction fiber layer 3 is not lower than 24 $Tf/mm^2$. It is more preferable that the modulus of elasticity of the axial direction fiber layer 3 is 30 to 60 $Tf/mm^2$. It is preferable that the density (specific gravity) of the axial direction fiber layer 3 is 1.4 to 1.8 $g/cm^2$.

It is preferable that a ratio of the weight of the oblique direction fiber 2 to the overall weight of the shaft 1 is 10 to 40 weight %, and also it is preferable that a ratio of the weight of the axial direction fiber 3 to the overall weight of the shaft 1 is 10 to 40 weight %.

The adjustment layer 5 is composed of fiber-reinforced prepreg in which reinforcement fiber is impregnated with synthetic resin in the same manner as that of the main body layer 4. In order to provide a lower modulus of elasticity than that of the main body layer 4, and also in order to provide a higher specific gravity than that of the main body layer 4, the following reinforcement fibers are used. That is, examples of usable reinforcement fibers are: glass fiber, alumina fiber, quartz fiber, metallic fiber+glass fiber, metallic fiber, metallic coating glass fiber, metallic coating low elasticity carbon fiber, and metallic net. Especially, it is preferable to use fiber, the modulus of elasticity of which is not higher than 19 $Tf/mm^2$.

Examples of resin used for the adjustment layer are: epoxy resin, urethane resin, and polyester resin. The resin content of the adjustment layer is preferably not lower than 20 weight %, and the resin content of the adjustment layer is more preferably 25 to 80 weight %, which is higher than that of the main body layer. Due to the foregoing, it is possible to enhance the adhesion property between layers, and further it is possible to prevent the layers from being separated and damaged, and the mechanical strength can be enhanced.

It is preferable that the thickness of the adjustment layer 5 is 0.2 to 1.0 mm. It is preferable that the modulus of elasticity of the adjustment layer 5 is lower than that of the main body layer 4, that is, it is preferable that the modulus of elasticity of the adjustment layer 5 is not higher than 20 $Tf/mm^2$. It is preferable that the specific gravity of the adjustment layer 5 is higher than that of the main body layer 4, that is, it is preferable that the specific gravity of the adjustment layer 5 is not lower than 2.0 $g/cm^3$.

Especially when carbon fiber is used for the reinforcement fiber of the axial direction fiber layer of the main body layer, and also when glass fiber is used for the reinforcement fiber of the adjustment layer, that is, when carbon fiber is combined with glass fiber, it is possible to provide a golf club shaft, the tenacity of which is high, and power can be accumulated in the shaft when a golfer swings the golf club. Since the layers of prepreg are rolled and integrally formed into one body, it is possible to prevent the separation and damage of the layers of prepreg.

In this connection, the modulus of elasticity and the specific gravity of the main body layer 4 and the adjustment layer 5 can be controlled by not only changing the material of reinforcement layer and synthetic resin but also changing a quantity of impregnation of synthetic resin.

The adjustment layer 5 is not limited to be the innermost layer of the main body layer 4 as shown in FIGS. 2 to 4, but the adjustment layer 5 may be arranged in the intermediate portion of the main body layer 4 so that the adjustment layer 5 can be formed as an intermediate layer. When the adjustment layer 5 is formed as an intermediate layer, it may be arranged between the oblique direction fiber layer 2 and the axial direction fiber layer 3 so that both layers can be prevented from separating, or alternatively it may be arranged between a plurality of axial direction fibre layers 3 so that the torsional strength and rigidity can be enhanced.

In this connection, it is possible to form the adjustment layer 5 inside the main body layer 4 and also it is possible to form the adjustment layer 5 between the oblique direction fiber layer 2 and the axial direction fiber layer 3.

The adjustment layer 5 may be formed only in a portion of the overall length of the shaft 1 unlike the arrangement of the adjustment layer 5 which is formed in the overall length of the shaft 1. When the adjustment layer 5 is formed in a portion of the overall length of the shaft 1, it is preferable that the adjustment layer 5 is formed in a range from the front end (on the head attaching side) of the shaft 1 to a position distant from the front end by 30% of the shaft length, or alternatively it is preferable that the adjustment layer 5 is formed in a range from the base end (on the grip attaching side) of the shaft 1 to a position distant from the base end by 30% of the shaft length. In any case, the adjustment layer 5 is preferably formed in a range, the length of which is not less than 30% of the overall length of the shaft 1. In this connection, the adjustment layer 5 is more preferably formed in a range, the length of which is not less than 50% of the overall length of the shaft 1. Of course, it is the most preferable that the adjustment layer 5 is formed over the entire length of the shaft 1.

When the adjustment layer 5 is formed in a long region of the overall length of the shaft 1, a correlation between the change in bend and torsional rigidity and the change in the weight in the axial direction can be enhanced. As a result, it is possible to avoid a local bend and torsion of the shaft, and the shaft can be swung in accordance with the feeling of weight (weight balance). Accordingly, a golfer can swing the golf club smoothly without a feeling of incongruity.

Since the weight of the shaft is not locally distributed but the weight is distributed in a wide range in the axial direction of the shaft, it is possible for a golfer to swing the golf club smoothly without a feeling of incongruity. Accordingly, the directivity of a ball can be stabilized.

As described above, when the adjustment layer 5, the modulus of elasticity of which is lower than that of the main body layer, and the specific gravity of which is higher than that of the main body layer, is provided as the innermost layer or the intermediate layer, it is possible to effectively absorb vibration caused in the case of hitting a ball, that is, it is possible to reduce a shock caused in the case of hitting a ball. Accordingly, fluctuation of timing can be prevented when a golfer hits a ball, and the occurrence of mis-shot can be decreased.

The first reinforcement layer 6 and the second reinforcement layer 7 are provided at the end portion of the shaft on the head attaching side. The length of the first reinforcement layer 6 is approximately 10 to 20% of the overall length of the shaft 1, and the length of the second reinforcement layer 7 is approximately 15 to 30% of the overall length of the shaft 1.

The first reinforcement layer 6 and the second reinforcement layer 7 are composed of fiber-reinforced prepreg in which reinforcement fiber is impregnated with synthetic resin. Materials of the reinforcement fiber and synthetic resin may be the same as those of the main body layer and the adjustment layer.

It is preferable that the thickness of the first reinforcement layer 6 is 0.4 to 0.8 mm and the thickness of the second reinforcement layer 7 is 0.1 to 0.4 mm. In this connection, the first reinforcement layer 6 and the second reinforcement layer 7 are not necessarily provided.

The present invention provides a set of golf clubs, the volumetric ratio of the adjustment layer of which is increased as the golf club number is increased. Table 1 shows an example in which the volumetric ratio of the adjustment layer of each golf club is changed in accordance with the golf club number.

TABLE 1

| a \ h | 2 | 3 | 4 | 5 | 6 | 7 | 8 | 9 | PW |
|---|---|---|---|---|---|---|---|---|---|
| b (g) | 84 | 87 | 88 | 89 | 91 | 93 | 94 | 95 | 100 |
| c (mm) | 9.4 | 9.4 | 9.4 | 9.4 | 9.4 | 9.4 | 9.4 | 9.4 | 9.4 |
| d (mm) | 16.1 | 16.1 | 16.1 | 16.1 | 16.1 | 16.1 | 16.1 | 16.1 | 16.1 |
| e | 345 | 352 | 360 | 367 | 375 | 382 | 389 | 396 | 403 |
| cpm | S ← → L | | | | | | | | |
| f | S ← → L | | | | | | | | |
| g | S ← → L | | | | | | | | |

a Item
b Shaft weight (g)
c Diameter of front end (mm)
d Diameter of base end (mm)
e Frequency cpm
f Volumetric ratio of adjustment layer
g Volumetric ratio of oblique direction layer
h Number
S Small
L Larger In the example shown on Table 1, the larger the number of golf club is, the more the shaft weight is increased. Therefore, as the number of the golf club is increased, the frequency is successively increased by a difference of 5 to 15. Of course, the difference may be made larger. The larger the number of the golf club is, the higher the volumetric ratio (or the ratio of thickness of cross-section) of the adjustment layer is increased. The larger the number of the golf club is, the lower the volumetric ratio (or the ratio of thickness of cross-section) of the oblique direction layer is decreased.

In this connection, in the example shown on Table 1, the shaft weight is 84 to 100 g. However, as long as a relation between the number of the golf club and the weight is not reversed, the shaft weight may be arbitrarily determined. In general, the shaft weight is set at 50 to 140 g, however, the weight of this type shaft is preferably set at 70 to 120 g. The front end portion diameter and the base end portion diameter are the same for each number of the golf club. However, it is possible to adjust the front end portion diameter and the base end portion diameter at arbitrary values.

In the set of golf clubs described above, it is preferable that the bend rigidity of the shaft from the front end portion to a position distant from the front end portion by 20 cm is decreased as the number of the golf club is increased. In this case, the bend rigidity of the shaft from the front end portion to the position distant from the front end portion by 20 cm can be decreased linearly or stepwise as the number of the golf club is increased. The present invention is not limited to the specific example in which the bend rigidity of the shaft from the front end portion to the position distant from the front end portion by 20 cm is decreased, but it is possible to decrease the bend rigidity of the shaft from the front end portion to a position distant from the front end portion by 10 cm or 30 cm.

It is preferable that a difference in weight between the golf clubs is not lower than 15 g. In this case, the weight of the lightest shaft is preferably not less than 70 g. However, when there are clubs of long iron of #1 to #4 in which no adjustment layers are provided, the weight of the lightest shaft may be a value not more than 70 g.

In this connection, one of the characteristics of the present invention is the adjustment layer which is provided in the shaft. However, in the structure of the shaft in which the bend rigidity of the shaft from the front end portion to the position distant from the end portion by 20 cm is decreased as the number of the golf club is increased, it is possible to eliminate the adjustment layer with respect to the golf clubs of all numbers. Even if no adjustment layers are provided, when the rigidity of the front end portion of the shaft is decreased as the number of the golf club is decreased, it is possible to provide the same effect as that of the set of golf clubs in which the adjustment layers are provided.

Further, the modulus of elasticity of reinforcement fiber of fiber-reinforced prepreg used in the main body layer can be changed in a range from the high modulus of elasticity (40 to 90 Tf/mm$^2$) to the low modulus of elasticity (a value not higher than 30 Tf/mm$^2$) with respect to golf clubs from the long iron clubs (#1 to #3) to the short iron clubs (#7 to #PW). In the same manner, it is possible to change a quantity of impregnation of resin of the fiber-reinforced prepreg used in the main body layer in a range from the low content (not more than 25 weight %) to the high content (not less than 30 weight %) with respect to golf clubs from the long iron clubs (#1 to #3) to the short iron clubs (#7 to #PW). Due to the foregoing, adjustment can be effectively performed among the set of golf clubs.

EXAMPLE

A specific example of the present invention will be explained as follows.

Figure 5:
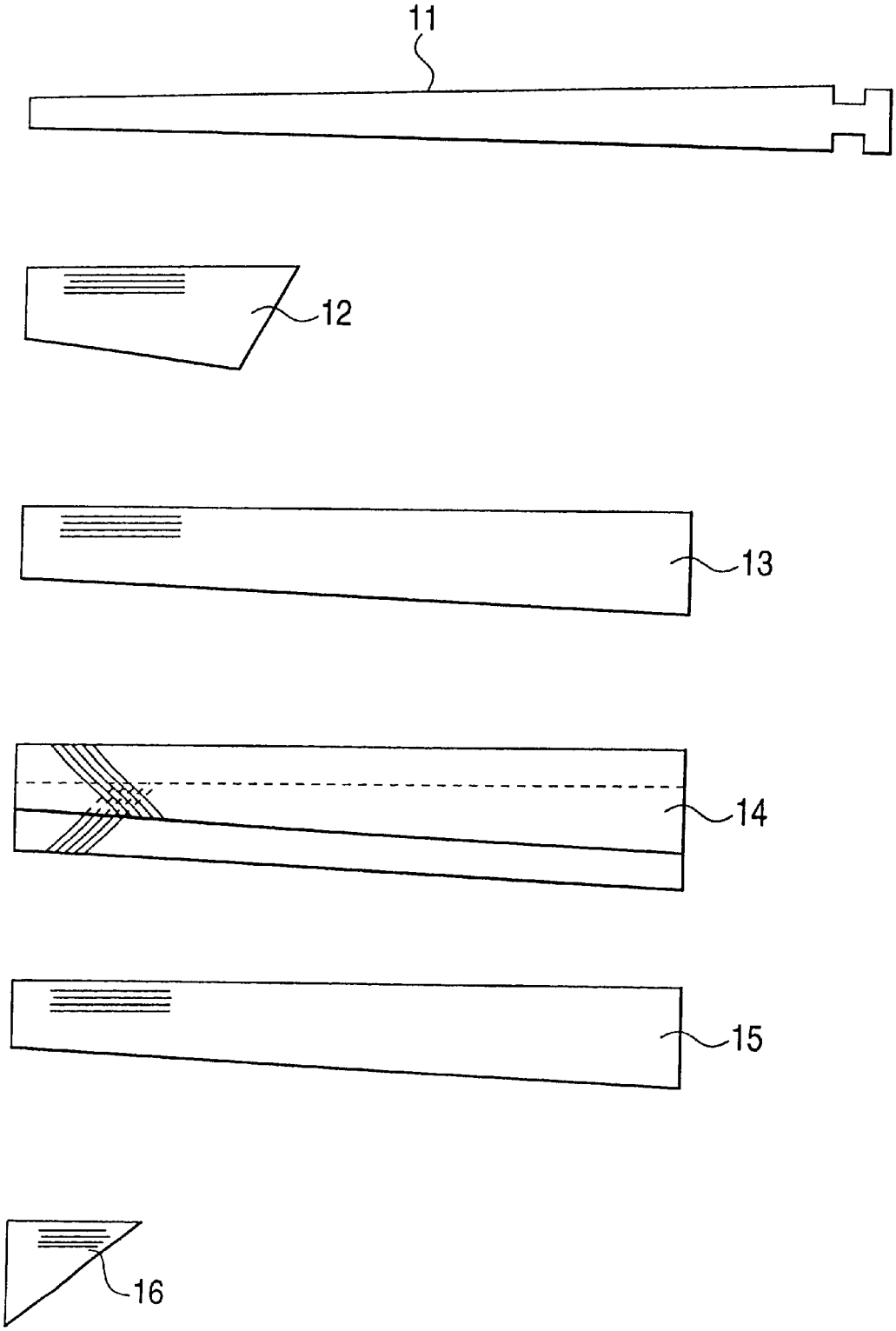
FIG. 5 is a view to explain a production process of the golf club shaft of the first example of the present invention.

First, referring to FIG. 5 the first specific example of production of the golf club shaft of the present invention will be explained below. As shown in FIG. 5, the fiber-reinforced prepreg sheet 12 for reinforcement was rolled round the mandrel 11 at the front end portion. Next, the glass-fiber-reinforced prepreg sheet 13 of low modulus of elasticity and high specific gravity, the oblique direction carbon-fiber-reinforced prepreg sheet 14, and the axial direction carbon-fiber-reinforced prepreg sheet 15 were successively rolled round the mandrel 11 with respect to the substantially overall length. Further, the fiber-reinforced prepreg 16 for reinforcement was rolled round the mandrel 11 at the front end portion.

After that, according to the common method, the rolled prepreg sheets were tightened up by means of taping and heated so that the prepreg sheets could be thermally set, the mandrel was removed from the rolled prepreg sheets, and the surfaces of the prepreg sheets were polished. In this way, the golf club shaft shown in FIGS. 1 to 4 was produced.

In this case, the fiber-reinforced prepreg sheet 12 for reinforcement was made in such a manner that carbon fiber was impregnated with epoxy resin; the fiber-reinforced prepreg sheet 13 of low modulus of elasticity and high specific gravity was made in such a manner that glass fiber was impregnated with epoxy resin, wherein the modulus of elasticity was not more than 20 Tf/mm$^2$, and the specific gravity was not lower than 2.0 g/cm$^3$; the oblique direction carbon-fiber-reinforced prepreg sheet 14 was made in such a manner that carbon fiber was impregnated with epoxy resin, wherein the modulus of elasticity was 40 Tf/mm$^2$ or 24 Tf/mm$^2$; the axial direction carbon-fiber-reinforced prepreg sheet 15 was made in such a manner that carbon fiber was impregnated with epoxy resin, wherein the modulus of elasticity was 40 Tf/mm$^2$; and the prepreg sheet 16 was made in such a manner that carbon fiber was impregnated with epoxy resin.

Thus obtained golf club shaft is shown in FIGS. 1 to 4, the thicknesses of the oblique direction fiber layer 2, axial direction fiber layer 3, adjustment layer 5, and first reinforcement layer and second reinforcement layer 7 of which were respectively 0.94, 0.46, 0.44, 0.32 and 0.11 mm.

A ratio of the volume of the adjustment layer 5 to the volume of all layers was 15%, and the overall weight of the shaft was 125 g. When a golfer swung the golf club shaft obtained in this example, the golf club was excellent in the weight balance and further it was possible to reduce a shock given to the golfer when he hit a golf ball. Even after the golf club had been used over a long period of time, no surface separation was caused, that is, the shaft was neither damaged nor set in fatigue permanently.

In this connection, in the above example, the adjustment layer 5 was provided inside the main body layer. However, even when the adjustment layer 5 was provided between the oblique direction fiber layer 2 and the axial direction fiber layer 3, it was possible to provide the same excellent effect.

Figure 6:
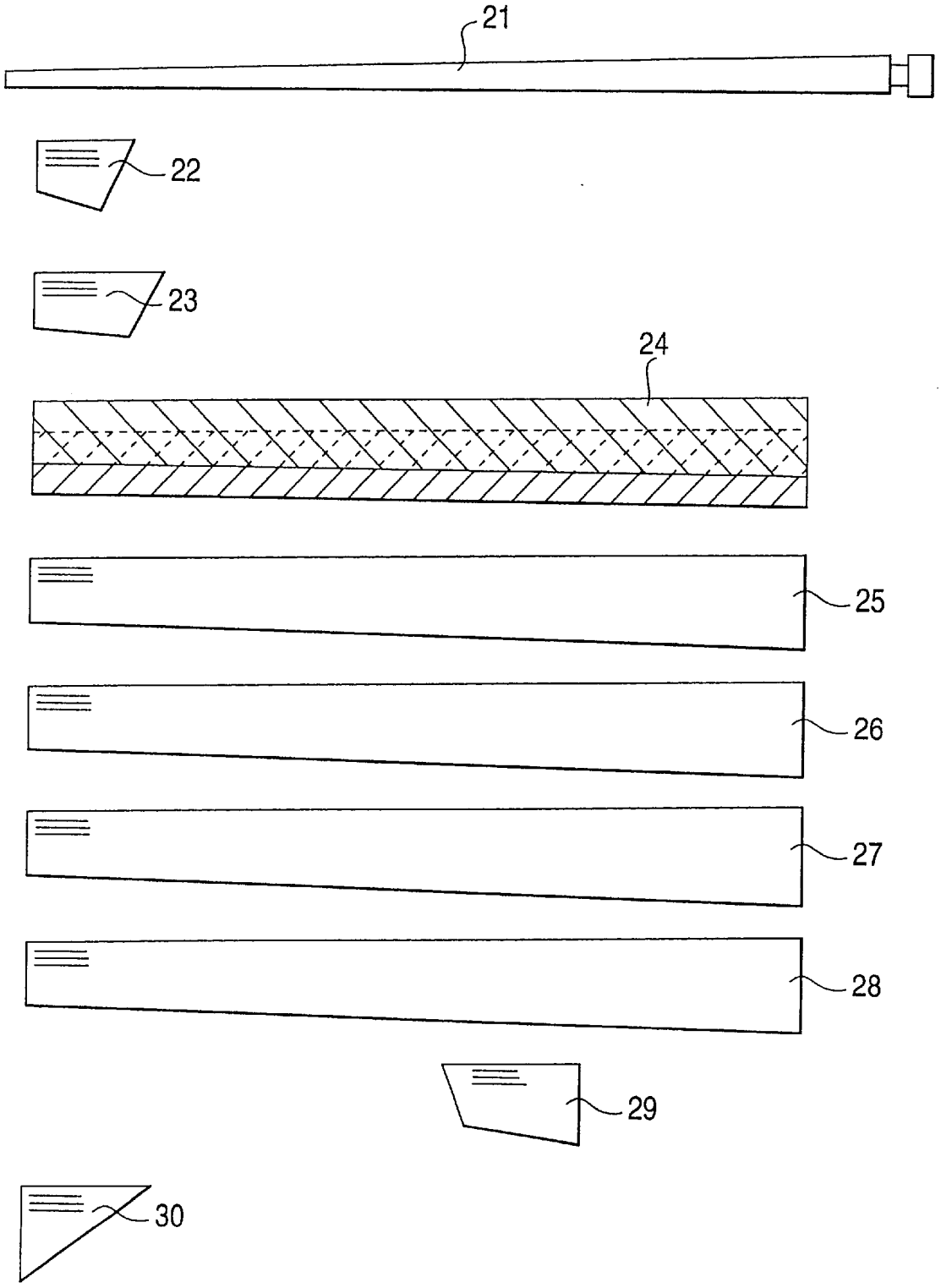
FIG. 6 is a view to explain a production process of the golf club shaft of the second example of the present invention.

FIG. 6 is a view showing the second specific example of production of the golf club shaft of the present invention. As shown in FIG. 6, the fiber-reinforced prepreg sheets 22, 23 were rolled round the front end portion of the mandrel 21. Then, the oblique direction fiber-reinforced prepreg sheet 24 and axial direction fiber-reinforced prepreg sheets 25, 26, 27, 28 were successively rolled on the mandrel 21 with respect to the overall length. Further, the fiber-reinforced prepreg sheets 29, 30 for reinforcement were rolled round the mandrel 21.

After that, according to the common method, the rolled prepreg sheets were tightened up by means of taping and heated so that the prepreg sheets could be set, the mandrel was removed from the rolled prepreg sheets, and the surfaces of the prepreg sheets were polished. In this way, the golf club shaft of this example was produced.

In this case, the fiber-reinforced prepreg sheets 22, 23 were made in such a manner that carbon fiber was impregnated with epoxy resin; the oblique direction fiber-reinforced prepreg sheet 24 was made in such a manner that carbon fiber was impregnated with epoxy resin; the axial direction fiber-reinforced prepreg sheet 25 was made in such a manner that carbon fiber was impregnated with epoxy resin and the thickness was 0.12 mm; the axial direction fiber-reinforced prepreg sheet 26 was made in such a manner that glass fiber was impregnated with epoxy resin and the thickness was 0.10 mm; the axial direction fiber-reinforced prepreg sheet 27 was made in such a manner that carbon fiber was impregnated with epoxy resin and the thickness was 0.15 mm; the axial direction fiber-reinforced prepreg sheet 28 was made in such a manner that carbon fiber was impregnated with epoxy resin and the thickness was 0.15 mm; and the fiber-reinforced prepreg sheets 29, 30 for reinforcement were made in such a manner that carbon fiber was impregnated with epoxy resin.

In this connection, the oblique direction fiber-reinforced prepreg sheet 24 and the axial direction fiber-reinforced prepreg sheets 27, 28 compose the main body layer, and the axial direction fiber-reinforced prepreg sheets 25, 26 compose the adjustment layer.

When a golfer swung the golf club shaft obtained in this example, the golf club was excellent in the weight balance and further it was possible to reduce a shock given to the golfer in the case of hitting a golf ball. Even after the golf club had been used over a long period of time, no surface separation of the layers was caused, that is, the shaft was neither damaged nor set in fatigue permanently.

In the first and the second example of the present invention explained above, the following preferable embodiment is provided.

(1) An arrangement in which carbon fiber is used for the reinforcement fiber of the axial direction fiber-reinforced prepreg sheet forming the main body layer, and an amount of the axial direction fiber-reinforced prepreg sheet rolled round the mandrel is not more than 50% of the total of the thickness (or volume) of the adjustment layer and the thickness (or volume) of the axial direction fiber layer, and it is preferable that the amount of the axial direction fiber-reinforced prepreg sheet rolled round the mandrel is not more than 30% of the total of the thickness (or volume) of the adjustment layer and the thickness (or volume) of the axial direction fiber layer.

When the above arrangement is adopted, even if the adjustment layer is mainly composed of the axial direction fiber (glass fiber), it is possible to provide a shaft, the tenacity of which is sufficiently high and power can be accumulated in the process of swinging the shaft. Further, the weight balance can be easily adjusted by the adjustment layer.

(2) An arrangement in which the thickness (or volume) of the adjustment layer is not less than 10% of the total thickness (or volume) except for the thickness (or volume) of the reinforcement portion and the front end portion. It is preferable that the thickness (or volume) of the adjustment layer is 20 to 80% of the total thickness (or volume) except for the thickness (or volume) of the reinforcement portion and the front end portion.

(3) An arrangement in which carbon fiber is used for the reinforcement fiber of the axial direction fiber-reinforced prepreg sheet composing the main body layer, and glass fiber is used for the reinforce fiber of the fiber-reinforced prepreg sheet so as to form the adjustment layer, and these main body layer and adjustment layer are combined with each other.

When the above arrangement is adopted, it is possible to obtain a shaft in which the bounce of carbon fiber is reduced and a sufficiently high tenacity is provided, and further power can be accumulated when a golfer hits a ball with the shaft. When glass fiber or fiber of low elasticity is used, it is possible to prevent the occurrence of a permanent set in fatigue of the shaft, which is caused when glass fiber or fiber of low elasticity is used, by combining it with highly elastic carbon fiber, the mechanical strength of which is high.

In this connection, only when carbon fiber is used, no tenacity can be provided when the shaft is bent in the process of swinging the shaft. Therefore, time from the bend to the bounce of the shaft is shortened in the case of downswing. Accordingly, it is impossible for a golfer to hit a ball with the best timing. Further, it is impossible for a golfer to give the maximum energy to a ball when he hits the ball. Therefore, the flying distance of the ball fluctuates and the directivity can not be stabilized.

On the other hand, when the main body layer on which carbon fiber is used and the adjustment layer on which glass fiber is used are combined with each other, the shaft can be provided with tenacity when it is bent, and further power can be accumulated in the club head. Accordingly, it becomes possible for a golfer to hit a ball with good timing, so that it is possible get distance stably, and the directivity can be stabilized.

(4) An arrangement in which the axial direction fiber layer using carbon fiber as reinforcement fiber is provided outside, and the adjustment layer is provided inside.

When the above arrangement is adopted, the rigidity of the shaft can be effectively enhanced. Bend of the shaft is received by the axial direction fiber layer, in which carbon fiber is used, when a load given to the shaft is light, and bend of the shaft is received by the overall shaft when a load given to the shaft is heavy. Consequently, as long as the carbon fiber is not broken, it is possible to prevent the advance of a permanent set in fatigue from the adjustment layer. Further, the adjustment layer may be composed of one prepreg sheet, or alternatively the adjustment layer may be divided into a plurality of layers and rolled on different layers.

(5) The adjustment layer is rolled round the substantially overall length of the shaft in the same manner as that of the main body layer. However, the adjustment layer may be locally rolled as follows. p1 (a) The adjustment layer is rolled in a portion from the front end to a position of ⅓ to ⅔ of the shaft (partially or entirely). Due to the foregoing, the tenacity of the front end portion can be enhanced.

(b) The adjustment layer is rolled in a portion from the base end to a position of ⅓ to ⅔ of the shaft (partially or entirely). Due to the foregoing, the tenacity of the base end portion can be enhanced.

(c) The adjustment layer is rolled in an intermediate portion of the shaft from ⅓ to ⅔ of the shaft (partially or entirely). Due to the foregoing, the tenacity of the intermediate portion can be enhanced.

As explained above, according to the golf club shaft of the present invention, inside the main body layer or in the middle of the main body layer, there is provided an adjustment layer on which the fiber-reinforced prepreg sheet is rolled, the specific gravity of which is higher than that of the fiber-reinforced prepreg of the main body layer, and the elasticity of which is lower than that of the fiber-reinforced prepreg of the main body layer. Accordingly, it is possible to provide a golf club shaft, the swing balance of which is good, and the bend balance and weight balance of which are good, so that the tenacity can be provided and power can be accumulated in the shaft in the process of swinging the golf club shaft. It is possible to prevent the occurrence of surface separation of the layers, that is, damage and a permanent set in fatigue caused by the surface separation can be prevented.

What is claimed is:

1. A golf club shaft comprising: a main body layer in which a first fiber-reinforced prepeg sheet, impregnated with synthetic resin, is rolled; and an adjustment layer in which a second fiber-reinforced prepeg sheet, impregnated with synthetic resin, is rolled, the adjustment layer being arranged inside the main body layer, wherein the specific gravity of the second fiber-reinforce prepeg sheet is higher than that of the first fiber-reinforced prepeg sheet, the elasticity of the second fiber-reinforced prepeg sheet is lower than that of the first fiber-reinforced prepeg sheet, and the main body layer includes an axial direction fiber layer on which a fiber-reinforced prepeg sheet, the axial direction fiber of which is impregnated with synthetic resin, is rolled and the specific gravity of the second fiber-reinforced prepeg sheet is higher than that of the fiber-reinforced prepeg composing the axial direction fiber layer, the elasticity of the second fiber-reinforced prepeg sheet is lower than that of the fiber reinforced prepeg composing the axial direction fiber layer, and the thickness of the adjustment layer is not lower than 50% of the thickness of the axial direction fiber layer of the main body layer, the amount of resin impregnation of the adjustment layer is larger than the amount of resin impregnation of the main body layer, and the adjustment layer adjusts a weight balance of the golf shaft into a heavier side while adjusting a bending rigidity into a smaller side to accumulate power therein.

2. A golf club shaft comprising: a main body layer in which a first fiber-reinforced prepeg sheet impregnated with synthetic resin, is rolled; and an adjustment layer in which a second fiber-reinforced prepeg impregnated with synthetic resin, is rolled, the adjustment layer being arranged at an intermediate portion of the main body layer, wherein the specific gravity of the second fiber-reinforce prepeg sheet is higher than that of the first fiber-reinforced prepeg sheet, the elasticity of the second fiber- reinforced prepeg sheet is lower than that of the first fiber-reinforced prepeg sheet, the main body layer includes an axial direction fiber layer on which a fiber-reinforced prepeg sheet, the axial direction fiber of which is impregnated with synthetic resin, is rolled and the specific gravity of the second fiber-reinforced prepeg sheet is higher than that of the fiber-reinforced prepeg composing the axial direction fiber layer, the elasticity of the second fiber-reinforced prepeg sheet is lower than that of the fiber reinforced prepeg composing the axial direction fiber layer, and the thickness of the adjustment layer is not lower than 50% of the thickness of the axial direction fiber layer of the main body layer, the amount of resin impregnation of the adjustment layer is larger than the amount of resin impregnation of the main body layer, and the adjustment layer adjusts a weight balance of the golf shaft into a heavier side while adjusting a bending rigidity into a smaller side to accumulate power therein.

* * * * *